US009921012B2

(12) United States Patent
Fujimoto et al.

(10) Patent No.: US 9,921,012 B2
(45) Date of Patent: Mar. 20, 2018

(54) WATER HEATING APPARATUS

(71) Applicant: NORITZ CORPORATION, Hyogo (JP)

(72) Inventors: Yu Fujimoto, Kakogawa (JP); Scott Isaksen, Torrance, CA (US); Bronwyn Planasch, Santa Ana, CA (US)

(73) Assignee: NORITZ CORPORATION, Hyogo (JP)

( * ) Notice: Subject to any disclaimer, the term of this patent is extended or adjusted under 35 U.S.C. 154(b) by 413 days.

(21) Appl. No.: 14/091,008

(22) Filed: Nov. 26, 2013

(65) Prior Publication Data

US 2015/0144074 A1 May 28, 2015

(51) Int. Cl.
*F28G 15/00* (2006.01)
*F24H 9/20* (2006.01)
(Continued)

(52) U.S. Cl.
CPC ..... *F28G 15/003* (2013.01); *F24D 19/0092* (2013.01); *F24H 9/0042* (2013.01);
(Continued)

(58) Field of Classification Search
CPC . F28G 15/003; F22D 7/04; F22D 7/00; F24H 9/2035; F24H 1/145; F24H 9/122
(Continued)

(56) References Cited

U.S. PATENT DOCUMENTS 6,236,321 B1 * 5/2001 Troost, IV ..... F24H 9/0042 126/116 A
6,833,032 B1 * 12/2004 Douglas ..... A21B 3/04 122/379
(Continued)

FOREIGN PATENT DOCUMENTS

JP 2003-106660 A 4/2003
JP 2003-254615 A 9/2003
(Continued)

OTHER PUBLICATIONS

An Office Action; "Notice of Reasons for Rejection," mailed by the Japanese Patent Office dated Dec. 5, 2017, which corresponds to Japanese Patent Application No. 2014-028606 and is related to U.S. Appl. No. 14/091,008.

*Primary Examiner* — Alissa Tompkins
*Assistant Examiner* — John Bargero
(74) *Attorney, Agent, or Firm* — Studebaker & Brackett PC

(57) ABSTRACT

A water heating apparatus includes a burner, a heat exchanger for heating hot and cold water with use of heat from the burner, a scale detector for detecting occurrence of scale clogging in the heat exchanger, a notifying unit for notifying an error when the scale detector detects occurrence of a scale greater than or equal to a predetermined amount, and a controller performing a control of allowing the notifying unit to notify an error and prohibiting combustion operation of the burner when the scale detector detects occurrence of a scale greater than or equal to the predetermined amount. The controller is configured to start a cleaning mode for cleaning inside the heat exchanger when the controller detects shifting operation to the cleaning mode after the combustion operation of the burner is prohibited.

13 Claims, 12 Drawing Sheets

(51) Int. Cl.

| | |
|---|---|
| ***F24H 9/00*** | (2006.01) |
| ***F24D 19/00*** | (2006.01) |
| ***F28G 9/00*** | (2006.01) |
| *F24H 1/14* | (2006.01) |

(52) U.S. Cl.
CPC ..... *F24H 9/2035* (2013.01); *F28G 9/00* (2013.01); *F24H 1/145* (2013.01)

(58) Field of Classification Search
USPC ..... 122/14.21, 14.3, 429, 91
See application file for complete search history.

(56) References Cited

U.S. PATENT DOCUMENTS

| | | | | |
|---|---|---|---|---|
| 2004/0161227 | A1* | 8/2004 | Baxter | F24H 9/2021 392/454 |
| 2007/0257122 | A1* | 11/2007 | Shimada | F23N 1/082 237/12 |
| 2011/0126861 | A1* | 6/2011 | Dorigo | A47L 15/0057 134/22.1 |
| 2012/0248879 | A1* | 10/2012 | Arrigoni | G05B 19/042 307/80 |
| 2013/0214053 | A1* | 8/2013 | Narita | F24H 9/2035 237/8 R |

FOREIGN PATENT DOCUMENTS

| | | | |
|---|---|---|---|
| JP | 2004-169930 | A | 6/2004 |
| JP | 2010-261651 | A | 11/2010 |
| JP | 2012-077990 | A | 4/2012 |
| JP | 2013-160488 | A | 8/2013 |

* cited by examiner

WATER HEATING APPARATUS

BACKGROUND OF THE INVENTION

Field of the Invention

The present invention relates to a water heating apparatus, and more particularly to a water heating apparatus having a function of detecting scale clogging.

Description of the Background Art

Use of a water heating apparatus for a long time causes a scale to adhere in a pipe of a heat exchanger. In particular, in the case where so-called hard water containing a large quantity of calcium ion and magnesium ion is used, the amount of adhesion of the scale becomes greater. When use of the water heating apparatus with adhesion of the scale continues, normal heat transmission of the heat exchanger may be impaired by the scale, thus damage such as cracks in the heat exchanger may occur due to generation of thermal stress caused by the scale. Therefore, it is necessary to implement cleaning for removing the scale at an appropriate time. Operation controls related to detection of a scale in water heating apparatuses are disclosed in the following PTDs 1 to 5.

According to PTD 1 (Japanese Patent Laying-Open No. 2013-160488), a water heating apparatus prohibits a hot water supplying operation at the time of occurrence of a heat transmission inhibiting factor caused by adhesion of a scale and the like, and also notifies the event. When a predetermined operation is performed, the water heating apparatus cancels the prohibition of the hot water supplying operation.

According to PTD 2 (Japanese Patent Laying-Open No. 2004-169930), a water heating apparatus assumes a life duration of a heat exchanger by monitoring combustion performance. When the life duration has come to end, the water heating apparatus notifies the event. According to PTD 3 (Japanese Patent Laying-Open No. 2003-254615), a water heater notifies an error when it detects scale clogging and the like in a heat exchanger. Then, the water heater eventually stops combustion.

According to PTD 4 (Japanese Patent Laying-Open No. 2010-261651), a water heating apparatus detects occurrence of scale clogging by detecting a temperature at an outlet of a heat exchanger.

According to PTD 5 (Japanese Patent Laying-Open No. 2012-77990), a latent heat recovery type water heater discharges a drain generated in the water heater to a bathroom using a re-heating pipe and thereafter cleans the re-heating pipe, and notifies the event of cleaning at that time.

SUMMARY OF THE INVENTION

None of the PTDs 1 to 5 discloses the operation control for implementing cleaning of removing a scale.

Further, according to PTD 1, even if occurrence of a heat transmission inhibiting factor caused by adhesion of a scale and the like is detected, when a user performs a predetermined operation, operation prohibition to the water heating apparatus is canceled until a predetermined period elapses. When the heat transmission inhibiting factor is detected, the water heating apparatus can be used temporarily by performing the predetermined operation. However, when the detection is erroneous, such error cannot be withdrawn. Further, since the operation prohibition is implemented immediately when the heat transmission inhibiting factor is detected, usability is not good.

An object of the present invention is to provide a water heating apparatus exhibiting enhanced convenience in the case of cleaning a scale.

One water heating apparatus according to the present invention includes a burner, a heat exchanger, scale detector, a notifying unit, and a controller. The heat exchanger heats hot and cold water with use of heat from the burner. The scale detector detects occurrence of scale clogging in the heat exchanger. The notifying unit notifies an error when the scale detector detects occurrence of a scale greater than or equal to a predetermined amount. The controller performs a control of allowing the notifying unit to notify an error and prohibiting combustion operation of the burner after the error is notified when the scale detector detects occurrence of a scale greater than or equal to the predetermined amount. The controller performs a control of starting a cleaning mode for cleaning inside the heat exchanger when shifting operation to the cleaning mode is detected after the combustion operation of the burner is prohibited by the controller.

According to the one water heating apparatus of the present invention, a control is performed such that the cleaning mode for cleaning inside the heat exchanger is automatically started when the shifting operation to the cleaning mode is detected after the controller prohibits the combustion operation of the burner. Since the cleaning mode is automatically started in such a manner, damage to the heat exchanger due to scale clogging can be prevented appropriately. Further, the determination on whether or not cleaning has been performed for a required time period, whether or not the cleaning operation has been performed securely, and the like can be performed on the side of the water heating apparatus, and the operation required on the side of equipment during cleaning can be performed automatically. Accordingly, the cleaning operation can be performed more accurately and promptly as compared to the case where an operator manually performs the cleaning operation and associated works. From the above, convenience in the case of cleaning a scale can be enhanced.

In the water heating apparatus described above, the notifying unit includes a display unit. The controller controls the display unit to display a required time to termination of the cleaning mode when the cleaning mode is started. Accordingly, an operator can accurately know the time of terminating the cleaning operation.

In the water heating apparatus described above, the controller performs a control of storing in a storage unit a detection history of detection of a scale by the scale detector and an error notifying history of an error notified by the notifying unit in the cleaning mode, and a control of deleting the detection history and the error notifying history from the storage unit when the cleaning mode is terminated. The history is deleted after a scale is removed by cleaning in the manner described above, so that the scale detection and error notifying can be started from an initial state.

In the water heating apparatus described above, the controller performs a control of cancelling prohibition of the combustion operation of the burner when the operation of cancelling the cleaning mode is detected after the error notifying history is deleted. Accordingly, a user can use the water heating apparatus without any restriction until the next scale clogging is detected.

The controller is configured to switch an operation mode of the water heating apparatus to a shifting mode for shifting to the cleaning mode based on a comparison between an integrated value of a combustion time of the burner and a predetermined value and on detection of scale clogging by the scale detector. Accordingly, the operation mode of the water heating apparatus can be switched to the shifting mode for shifting to the cleaning mode based on the combustion time and the detection of a scale.

The water heating apparatus further includes a sensor for detecting a flow rate in the heat exchanger. The controller is configured to prohibit the combustion operation of the burner when a time during which a predetermined flow rate is not detected in the heat exchanger continues for a first time period after the error is outputted, or when a second time period elapses after scale clogging is detected. Accordingly, whether or not to implement combustion prohibition can be determined based on the time during which the predetermined flow rate is not detected and on the elapsed time from the detection of scale clogging. Therefore, the water heating apparatus can be used for a predetermined time period after an error is notified.

The water heating apparatus described above further includes an operation receiving unit for receiving user operation. The controller is configured to cancel the prohibition of the combustion operation of the burner for a third time period when resetting operation is received after the combustion operation of the burner is prohibited. Accordingly, even when the combustion operation is prohibited, a user can temporarily cancel the prohibition for the third time period by performing the resetting operation.

The controller described above is configured to allow the display unit to output an error when a third time period elapses after prohibition of the combustion operation of the burner is canceled and scale clogging is detected by the scale detector, and the controller is configured to prohibit the combustion operation of the burner again when a time during which a predetermined flow rate is not detected in the heat exchanger continues for a first time period after the error is outputted or when a second time period elapses after the scale clogging is detected. Accordingly, after the prohibition of the combustion operation is canceled only for the second time period, the prohibition of the combustion operation can be implemented again based on the elapsed time from the detection of a scale and on duration of the time during which the predetermined flow rate is not detected.

The controller is configured to shorten the third time period as the number of cancelling the prohibition of the combustion operation of the burner increases. Accordingly, as the elapsed time becomes longer after the scale clogging is detected, duration of the period of temporarily cancelling the prohibition of the combustion operation can be shortened.

The controller described above is configured to switch the operation mode to the cleaning mode when the number of cancelling the prohibition of the combustion operation of the burner exhibits a predetermined number and the shifting operation is received. Accordingly, when the number of cancelling the prohibition of the combustion operation reaches the predetermined number, a user can switch the operation mode to the cleaning mode by performing the shifting operation.

The water heating apparatus further includes an operation receiving unit for receiving user operation. The controller is configured to cancel prohibition of combustion operation of the burner for a predetermined time period when cancelling operation is received prior to switching to a cleaning mode after the combustion operation of the burner is prohibited. Accordingly, a user can cancel the prohibition of the combustion operation for a predetermined time period by performing the cancelling operation prior to switching to the cleaning mode.

The cancelling operation described above is an operation of inserting or detaching a connector terminal. Thus, the water heating apparatus can receive user operation to the connector terminal as the cancelling operation.

The controller is configured to cancel the combustion operation of the burner for a predetermined time period and thereafter prohibit again the combustion operation of the burner. Accordingly, the combustion operation prohibition due to detection of scale clogging can be temporarily canceled, and the prohibition of the combustion operation can be implemented again.

Another water heating apparatus according to the present invention includes a burner, a heat exchanger for heating hot and cold water with use of heat from the burner, a sensor for detecting a flow rate in the heat exchanger, and a controller having a scale detector for detecting occurrence of scale clogging in the heat exchanger based on a temperature of the heat exchanger. The controller is configured to allow a display unit to output an error when an integrated value of a combustion time of the burner exhibits a predetermined value and scale clogging is detected by the scale detector, and is configured to prohibit combustion operation of the burner when a time during which a predetermined flow rate is not detected by the sensor continues for a first time period after the error is outputted or when a second time period elapses after scale clogging is detected. Thus, the combustion operation of the burner can be prohibited based on the integrated value of the combustion time of the burner, the time during which the predetermined flow rate is not detected, and the elapsed time from the detection of scale clogging. Accordingly, the water heating apparatus can be used for the predetermined time period even after the error is outputted.

Yet another water heating apparatus according to the present invention includes a burner, a heat exchanger for heating hot and cold water with use of heat from the burner, a sensor for detecting a flow rate in the heat exchanger, an operation receiving unit for receiving user operation, and a controller having a scale detector for detecting occurrence of scale clogging in the heat exchanger based on a temperature of the heat exchanger. The controller is configured to allow a display unit to output an error and thereafter prohibit combustion operation of the burner when scale clogging is detected by the scale detector, and configured to cancel prohibition of the combustion operation of the burner for a predetermined time period when predetermined operation is received after the combustion operation of the burner is prohibited. Thus, after the scale clogging is detected and the combustion operation of the burner is prohibited, a user can cancel the combustion operation for a predetermined time period by implementing the predetermined operation.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
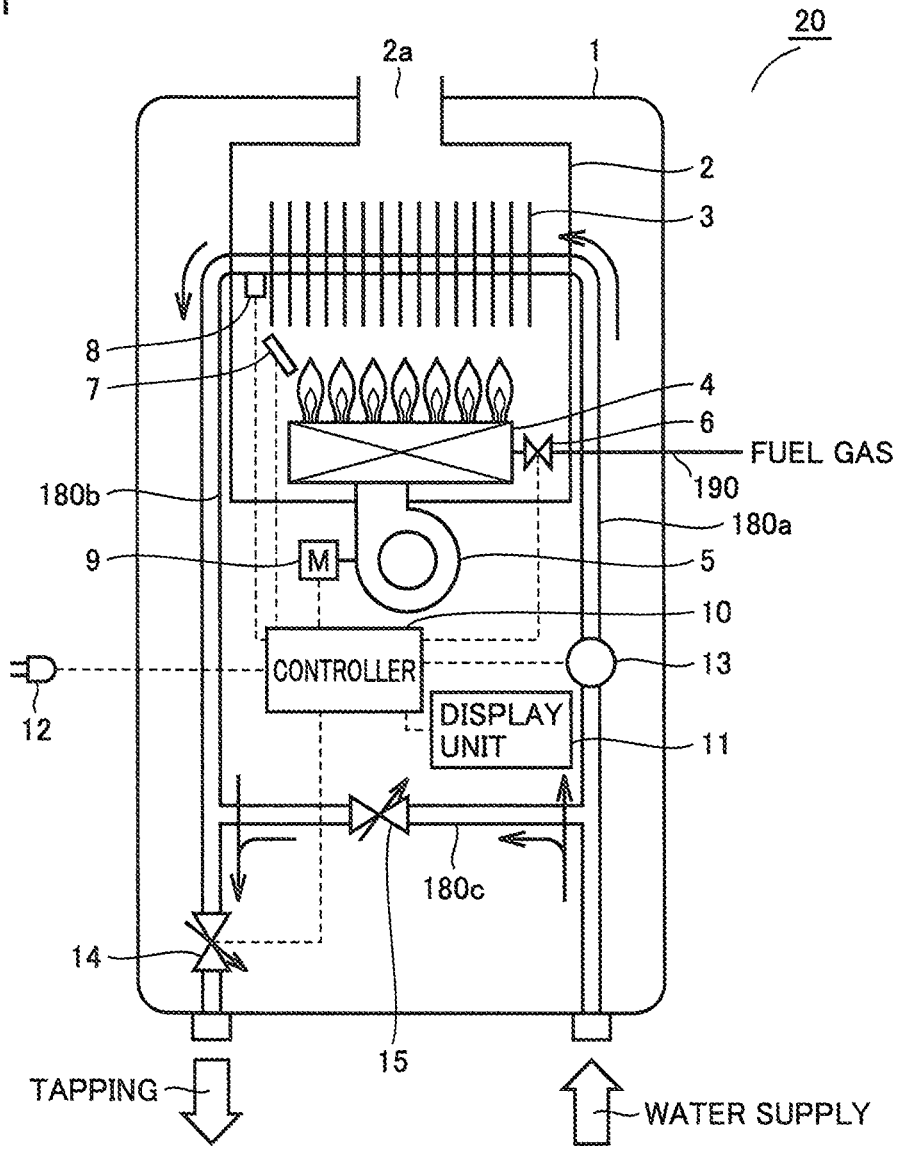
FIG. 1 represents a configuration of a water heating apparatus according to an embodiment of the present invention.

Hereinafter, an embodiment of the present invention will be described in detail with reference to the drawings. The same or corresponding parts illustrated in the drawings have the same reference numerals allotted, and details thereof basically will not be repeated.

(Hardware Configuration of the Apparatus)

FIG. 1 represents a configuration of a water heating apparatus 20 according to an embodiment of the present invention. Referring to FIG. 1, water heating apparatus 20 mainly includes a case 1, a water heater body 2, a scale detector 8, a controller 10, a display unit 11, a power supply plug 12, a flow rate sensor 13, a flow rate adjusting valve 14, pipes 180*a*-180*c*, and a gas pipe 190.

In case 1, there are arranged water heater body 2, controller 10, display unit 11, flow rate sensor 13, flow rate adjusting valve 14, pipes 180*a*-180*c*, and the like. In water heater body 2, there are arranged a heat exchanger 3, a burner 4, and a blower 5. Water heater body 2 is provided with an exhaust port 2*a* and an intake port (not illustrated).

Heat exchanger 3 heats hot and cold water with use of heat from burner 4, and specifically performs a heat exchange with combustion gas generated in burner 4. Heat exchanger 3 has a plurality of plate-like fins and a heat-transfer pipe penetrating through the plurality of fins.

Burner 4 generates combustion gas by combusting fuel gas. Burner 4 is connected with gas pipe 190. This gas pipe 190 supplies fuel gas to burner 4. A gas valve 6 is attached to this gas pipe 190. This gas valve 6 is, for example, an electromagnetic valve. An ignition plug 7 is arranged above burner 4. This ignition plug 7 generates an ignition spark with a target provided at burner 4 to generate flame on fuel-air mixture blowing out from burner 4.

Burner 4 combusts fuel gas supplied from gas pipe 190 to generate heat (it will be referred to as "combustion operation"). The heat generated by the combustion of burner 4 is transmitted through heat exchanger 3 to hot and cold water flowing through a heat-transfer pipe of heat exchanger 3, so that the hot and cold water is heated.

Blower 5 supplies air required for combustion to burner 4. This blower 5 is, for example, a fan, and is configured to be rotatable with a drive force given by a fan motor 9 such as a direct-current motor. Blower 5 forcibly supplies air from the intake port to inside of water heater body 2 and discharges air used for combustion to outside from exhaust port 2*a*.

Scale detector 8 detects occurrence of scale clogging in heat exchanger 3. This scale detector 8 is, for example, a thermistor (water heater body thermistor), and is arranged so as to detect an outlet temperature (water heater body temperature) which is a temperature of hot water immediately after being tapped from an outlet of heat exchanger 3. This scale detector 8 may be attached to a tapping pipe 180*b* on a downstream of heat exchanger 3 or may be arranged at the heat-transfer pipe inside heat exchanger 3. Further, other than scale detector 8 measuring a temperature of the water heater body like the water heater body thermistor, scale detector 8 may, for example, measure reduction in a flow rate of hot and cold water caused by scale clogging on a downstream of heat exchanger 3.

Pipes 180*a*-180*c* include a water supply pipe 180*a*, a tapping pipe 180*b*, and a bypass pipe 180*c*. Water supply pipe 180*a* is a pipe for supplying water to heat exchanger 3 (more particularly, to the heat-transfer pipe) and is connected to a water supply side of heat exchanger 3. Tapping pipe 180*b* is a pipe for tapping from heat exchanger 3 and is connected to a tapping side of heat exchanger 3. Bypass pipe 180*c* bypasses water from water supply pipe 180*a* and leads the water to tapping pipe 180*b*, and it connects the water supply pipe and the tapping pipe.

Bypass pipe 180*c* is connected with a bypass flow rate adjusting valve 15. Bypass flow rate adjusting valve 15 controls a flow of hot and cold water through bypass pipe 180*c* This bypass flow rate adjusting valve 15 may or may not be provided at bypass pipe 180*c*.

Flow rate sensor 13 is provided on a downstream side from a junction between water supply pipe 180*a* and bypass pipe 180*c*.

Flow rate adjusting valve 14 is provided on a downstream side from a junction between tapping pipe 180*b* and bypass pipe 180*c*. Flow rate adjusting valve 14 is a flow rate adjusting valve for adjusting a tapping amount of hot and cold water so that hot water having a set hot water supply temperature can be supplied, and it also serves as a shut-off valve by being completely closed. Flow rate adjusting valve 14 is, for example, an electric flow path open-close valve configured to adjust an opening degree with use of a stepping motor.

Display unit 11 is configured to notify an error when scale detector 8 detects occurrence of scale clogging of an amount greater than or equal to a predetermined amount, and it can serve as a notifying unit. This display unit 11 is, for example, a liquid crystal display device. In the present embodiment, the case is described where display unit 11 is mounted to water heating apparatus 20. However, display unit 11 may be configured as a separate body from water heating apparatus 20 and mounted to a remote control device capable of remotely operating the water heating apparatus. Further, other than display unit 11, a speaker generating sound and the like may be employed as a notifying unit for notifying an error.

Controller 10 is electrically connected to each of gas valve 6, ignition plug 7, scale detector 8, fan motor 9, display unit (notifying unit) 11, power supply plug 12, flow rate sensor 13, flow rate adjusting valve 14, and the like. Controller 10 receives power and supplies power to each part by inserting power supply plug 12 to a power outlet (not illustrated).

This controller 10 has a function of controlling each part so as to allow the notifying unit to notify an error and prohibit combustion of the burner after the error is notified, when scale detector 8 detects occurrence of scale clogging of an amount greater than or equal to a predetermined amount. Further, controller 10 has a function of performing a control of starting a cleaning mode for cleaning inside heat exchanger 3 when it is detected that shifting operation to the cleaning mode is performed after the combustion operation of burner 4 is prohibited by controller 10.

Further, controller 10 has a function of controlling display unit 11 to display a required time to termination of the cleaning mode when the cleaning mode is started. Further, controller 10 has a function of storing in a storage unit a detection history of detection of a scale by scale detector 8 and an error notifying history of an error notified by the display unit in the cleaning mode and deleting the detection history and the error notifying history from the storage unit after the cleaning mode is terminated.

Further, controller 10 has a function of performing a control of cancelling prohibition of the combustion operation of burner 4 when it is detected that the operation of cancelling the cleaning mode is performed after the error notifying history is deleted. It should be noted that the arrow illustrated in FIG. 1 indicates a direction of a flow of fluid (water or hot water).

(Functional Configuration)

Figure 2:
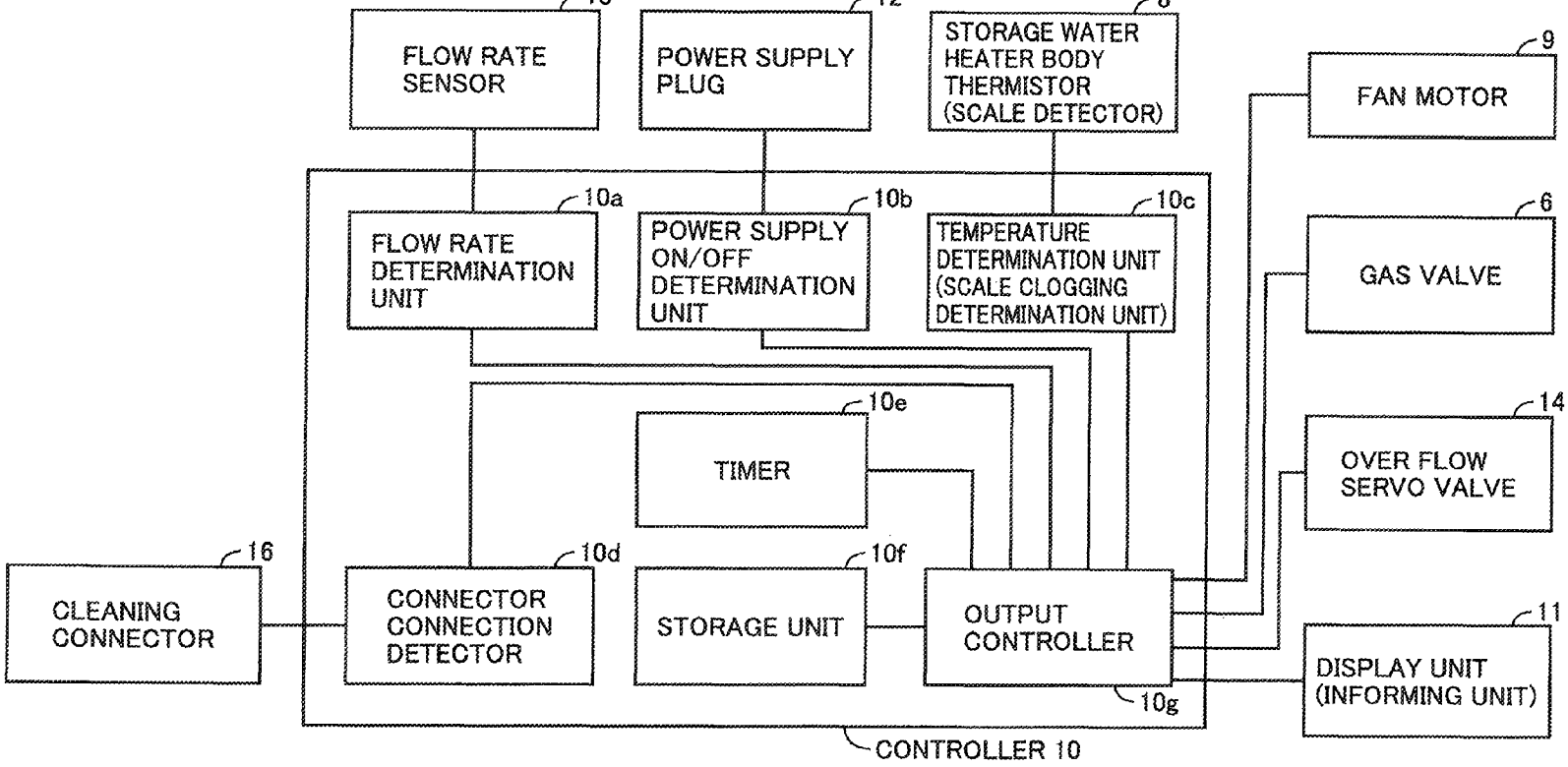
FIG. 2 represents a functional configuration of a controller according to the embodiment of the present invention.

FIG. 2 represents one example of a functional configuration of controller 10. Referring to FIG. 2, controller 10 mainly includes a flow rate determination unit 10*a*, a power supply ON/OFF determination unit 10*b*, a scale clogging determination unit 10*c*, a connector connection detector 10*d*, a timer 10*e*, a storage unit 10*f*, and an output controller 10*g*.

Flow rate determination unit 10*a* is configured to receive a detection value outputted from flow rate sensor 13. This flow rate determination unit 10*a* determines a flow rate detected by flow rate sensor 13, and it determines, for example, whether or not the flow rate detected by flow rate sensor 13 exhibits a minimum operation quantity (MOQ).

Power supply ON/OFF determination unit 10*b* is configured to receive power from power supply plug 12. This power supply ON/OFF determination unit 10*b* determines whether or not power is supplied by inserting power supply plug 12 to the power supply outlet by user operation.

Scale clogging determination unit 10*c* is configured to receive a detection value outputted from scale detector 8. This scale clogging determination unit 10*c* determines whether or not scale clogging occurs based on the detection value detected by scale detector 8. In the case where scale detector 8 is, for example, a water heater body thermistor, scale clogging determination unit 10*c* serves as a temperature determination unit for determining whether or not a temperature rise detected by the water heater body thermistor after hot water supplying operation is stopped (referred to as "post-boiling temperature") is higher than or equal to a predetermined temperature.

Connector connection detector 10*d* is connected to cleaning connector 16. This connector connection detector 10*d* determines whether or not cleaning connector 16 is in the connected state or in the disconnected state (detached state) by user operation.

Controller 10 includes an MPU (Micro Processing Unit) which is not illustrated in the drawings. The MPU includes a memory corresponding to storage unit 10*f* which will be described later and timer 10*e* which will be described later. The MPU executes a program stored in the memory to control each part of water heating apparatus 20.

Timer 10*e* counts up an elapsed time from the time of starting measurement or counts down a remaining time to a time set in advance. Storage unit 10*f* is constituted of a volatile and non-volatile recording media such as a ROM (Read Only Memory) and a RAM (Random Access Memory).

Each of flow rate determination unit 10*a*, power supply ON/OFF determination unit 10*b*, scale clogging determination unit 10*c*, connector connection detector 10*d*, timer 10*e*, and storage unit 10*f* is electrically connected to output controller 10*g*. Accordingly, based on information from each of flow rate determination unit 10*a*, power supply ON/OFF determination unit 10*b*, scale clogging determination unit 10*c*, connector connection detector 10*d*, timer 10*e*, and storage unit 10*f*, output controller 10*g* outputs instructions and signals for controlling operation of fan motor 9, gas valve 6, flow rate adjusting valve 14, display unit (notifying unit) 11 and the like.

Fan motor 9 rotates in accordance with a drive signal from controller 10, and blower 5 is operated in conjunction with the rotation. A blast volume of blower 5 is variably controlled by the drive signal from controller 10.

A degree of opening and closing of gas valve 6 is controlled in accordance with instruction from controller 10, and a gas pressure supplied to burner 4 is controlled in turn. The gas pressure is variably controlled, so that a gas supply amount per unit time with respect to burner 4 is controlled.

When a stepping motor of flow rate adjusting valve 14 is rotated in accordance with the drive signal from controller 10, flow rate adjusting valve 14 is operated in conjunction therewith. A degree of opening and closing of flow rate adjusting valve 14 is variably controlled by a control signal from controller 10.

Each part in controller 10 shown in FIG. 2 is achieved by a program executed by the MPU or by a combination of the program and a circuit.

Figure 10:
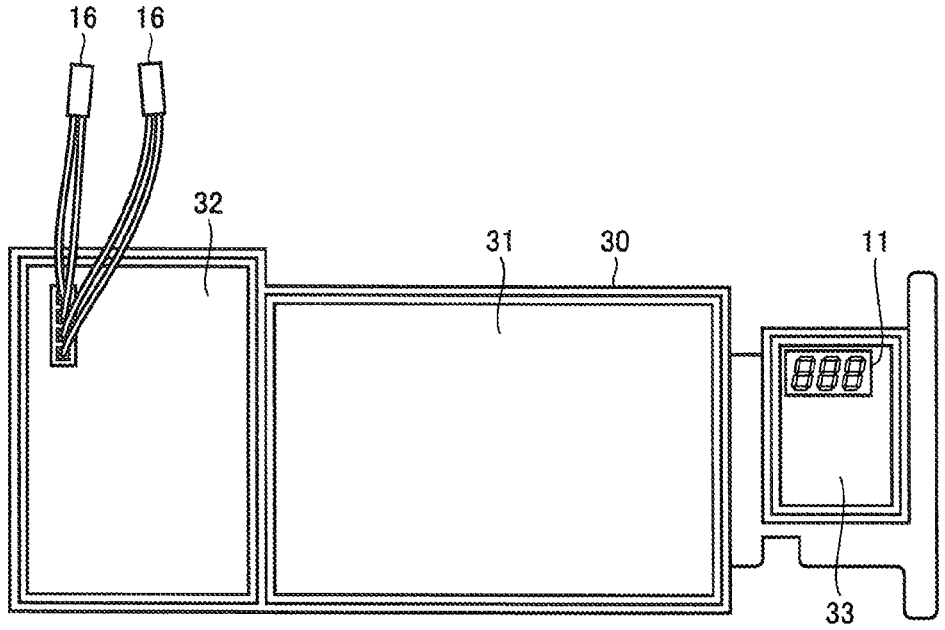
FIG. 10 represents a cleaning connector according to the embodiment of the present invention.

Cleaning connector 16 shown in FIG. 2 has such a configuration as shown in FIG. 10. In other words, a controller case 30 is arranged in water heating apparatus 20. For example, circuit boards 31, 32, 33, having a control circuit of controller 10 and/or a power supply circuit for a power supply unit formed thereon, are mounted in controller case 30. Cleaning connector 16 is connected to, for example, circuit board 32, so that it is electrically connected to a circuit formed on circuit boards 31, 32, 33.

This cleaning connector 16 has, for example, a pair of terminals, and is so configured as to enable connection and disconnection (detachment) between the pair of terminals. By performing the operation of connecting and disconnecting the pair of terminals of cleaning connector 16, the signal is transmitted to a control circuit or the like formed on circuit boards 31, 32. The operation of connecting the pair of terminals of cleaning connector 16 is set, for example, as a shifting operation to the cleaning mode, and the operation of disconnecting the pair of terminals of cleaning connector 16 is set, for example, as a cancelling operation of the cleaning mode.

The position at which cleaning connector 16 is connected to circuit board 32 is not limited to the position shown in FIG. 10. Cleaning connector 16 may be connected at other position of circuit board 32. Further, cleaning connector 16 is not always necessary to be connected to circuit board 32, and it may be connected to circuit boards 31, 33.

Display unit 11 may be mounted to circuit board 33. This controller case 30 is arranged, for example, in case 1 of water heating apparatus 20. Therefore, when an operator performs the operation of connecting and disconnecting cleaning connector 16, it is necessary to open case 1 of water heating apparatus 20 and access controller case 30.

(Combustion Unit and Operation)

In the present embodiment, a combustion unit includes burner 4. In the case of stopping (prohibiting) combustion operation of burner 4, output controller 10*g* controls each part so as to close gas valve 6, stop supply of electric current to ignition plug 7 (disable ignition), and stop supply of electric current to fan motor 9 of blower 5 (stop motor) (this operation is also referred to as "to implement combustion prohibition"). To implement combustion prohibition, output controller 10*g* is at least necessary to stop fan motor 9.

In the case of allowing burner 4 to implement combustion, output controller 10*g* controls each part so as to supply electric current to fan motor 9 (enable motor rotation), open gas valve 6, and exert electric current to ignition plug 7 (enable ignition) (this operation is also referred to as "to implement combustion permission"). When the prohibition of combustion operation is cancelled to implement combustion permission, combustion is started.

(Operation Modes)

Operation modes of water heating apparatus 20 according to the embodiment of the present invention include a normal mode and a cleaning mode, as well as a shifting mode for shifting from the normal mode to the cleaning mode.

In the normal mode, the controller 10 implements combustion permission. Further, the normal mode includes a scale detection mode in which scale detector 8 detects whether or not scale clogging occurs in heat exchanger 3. When scale detector 8 detects scale clogging, controller 10 switches a mode from the normal mode to the shifting mode.

In the shifting mode preceding the cleaning mode, controller 10 implements combustion permission. When it is determined that a predetermined condition is satisfied during implementation of combustion permission, combustion prohibition or cancellation of combustion prohibition is implemented.

In the cleaning mode, controller 10 implements combustion prohibition. However, when a predetermined operation is received, the combustion prohibition is cancelled.

(Process Flow Chart)

FIGS. 3 to 8 represent process flow charts according to the embodiment of the present invention. A program and data for processes in accordance with these flow charts are stored in advance in storage unit 10*f* The process is achieved by the MPU of controller 10 executing the program.

Normal Mode and Scale Detection Mode

When power supply plug 12 of water heating apparatus 20 is inserted to a power supply outlet not illustrated in the drawing to start the supply of power, the normal mode is started (step ST (hereinafter, simply abbreviated to "ST") 3). In the normal mode, while combustion permission is implemented, a scale detection process (FIG. 8) is implemented (ST5).

Figure 8:
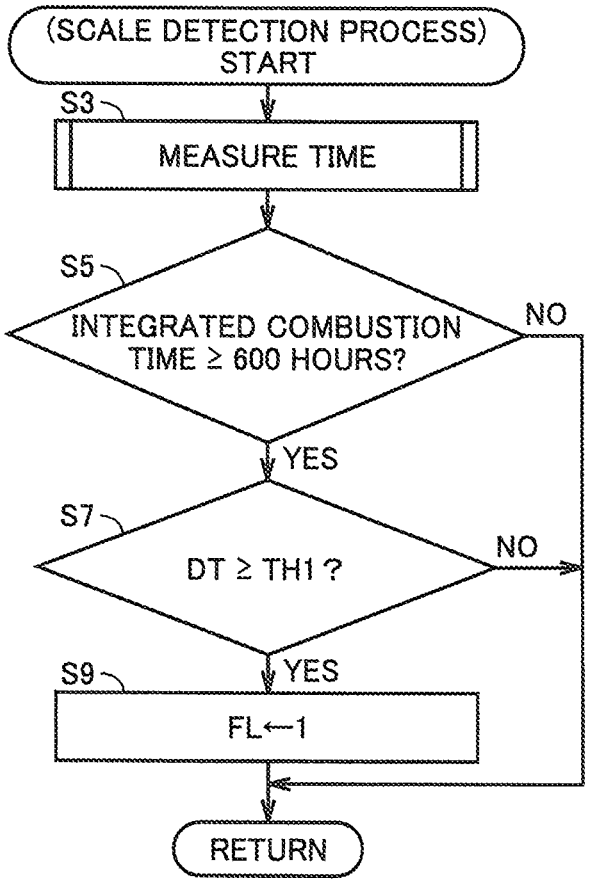
FIG. 8 represents a process flow chart according to the embodiment of the present invention.

Referring to FIG. 8, controller 10 integrates an operation time of the combustion unit in the normal mode based on an output of timer 10*e* to measure a time (step S (hereinafter, simply abbreviated to "S") 3). Controller 10 determines whether or not the integrated time satisfies the condition of "integrated time≥600 hours) (S5). In the case where the condition is not satisfied (NO in S5), in other words, the integrated time is shorter than 600 hours, the process returns to the original process. In the case where the condition is satisfied (YES in S5), in other words, the integrated time is longer than or equal to 600 hours, the process proceeds to S7. In the present embodiment, it is assumed that a scale is generated in pipe 180 when a time longer than or equal to 600 hours elapses from starting the normal mode. It should be noted that the condition is not limited to 600 hours.

Scale clogging determination unit 10*c* determines whether or not there is scale clogging based on an output of scale detector 8 (S7). Specifically, scale clogging determination unit 10*c* calculates a difference DT between a temperature rise detected by the water heater body thermistor after stopping the operation of supplying hot water (it is referred to as "post-boiling temperature") and a predetermined temperature. Further, scale detector 8 compares difference DT with a predetermined threshold value TH1 and determines whether or not the condition "DT≥TH1" is satisfied based on the result of comparison.

Herein, when a scale adheres in heat exchanger 3, a flow path of hot and cold water is reduced, and the amount of water held in heat exchanger 3 is reduced. Therefore, as the adhesion amount of the scale becomes greater, the detection temperature of the water heater body thermistor becomes higher, thus difference DT also becomes greater. Thus, in the case where a scale is clogging, the condition "DT≥TH1" is satisfied. Therefore, in this process flow, the case where the condition "DT≥TH1" is satisfied is considered as the case where the water heater body thermistor (scale detector 8) detected scale clogging of an amount greater than or equal to a predetermined amount.

When it is determined that the condition is satisfied (YES in S7), controller 10 sets "1" to a flag FL of storage unit 10*f* indicating that scale clogging is detected (S9). When it is determined that the condition is not satisfied (NO in S7), "1" is not set to flag FL. After that, the scale detection mode is terminated, and the process returns to the process of FIG. 3.

As a modified example, "1" is set to flag FL when it is determined that the condition "DT≥TH1" is satisfied successively for "M" times. Further, in the case of measuring the integration of time by means of a counter, a counted value for each time may be variable in accordance with an extent of difference DT.

Shifting Mode

Referring back to FIG. 3, controller 10 determines whether or not the condition "FL=1" is satisfied (ST7). When it is determined that the condition is not satisfied (NO in ST7), in other words, when scale clogging is not detected in the scale detection mode, the process returns to ST3.

On the other hand, when it is determined that the condition (FL=1) is satisfied (YES in ST7), controller 10 switches the operation mode from the normal mode to the shifting mode. In the shifting mode, firstly, the combustion permission/prohibition process is implemented (ST9).

Figure 5:
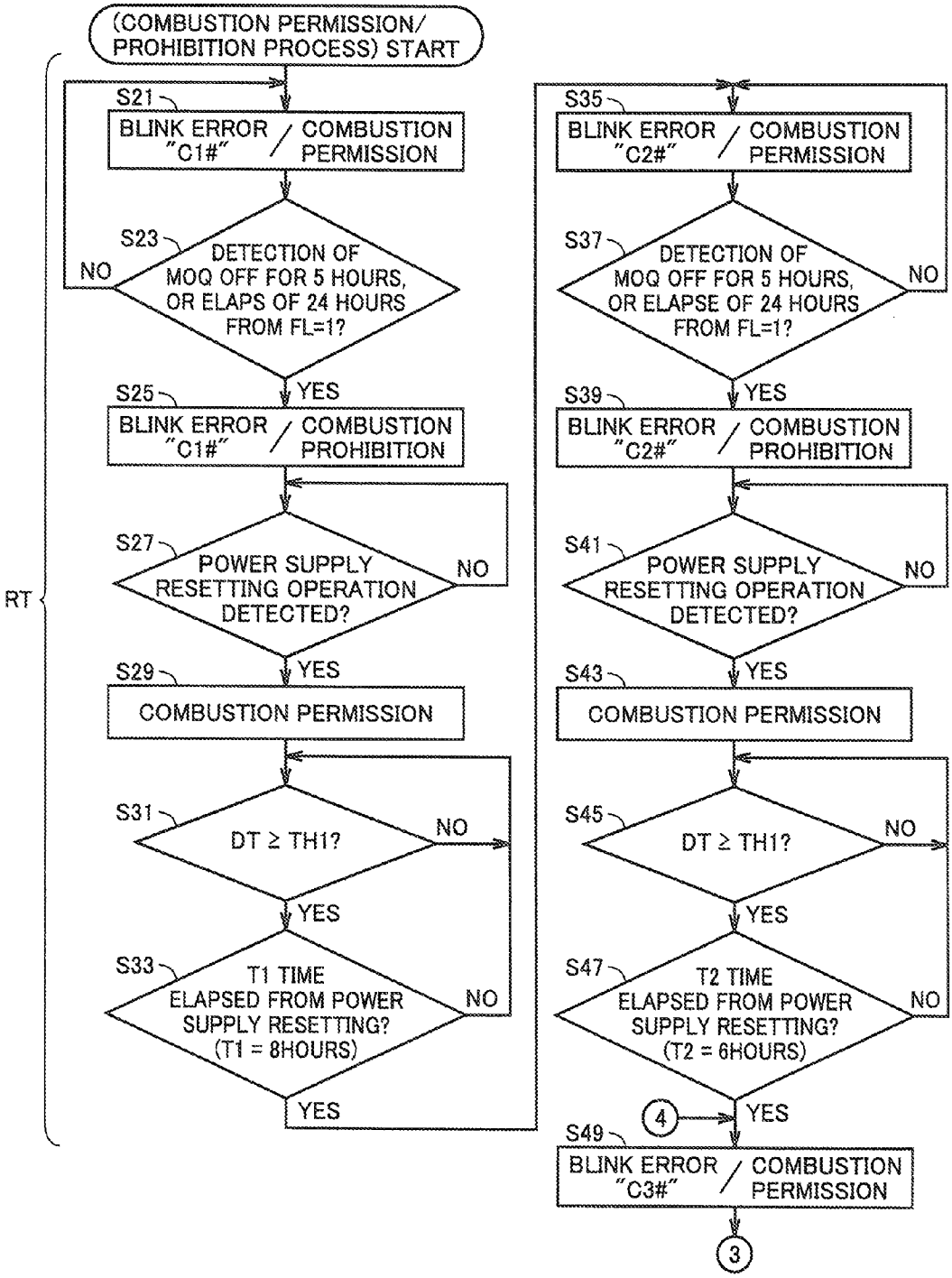
FIG. 5 represents a process flow chart according to the embodiment of the present invention.
Figure 6:
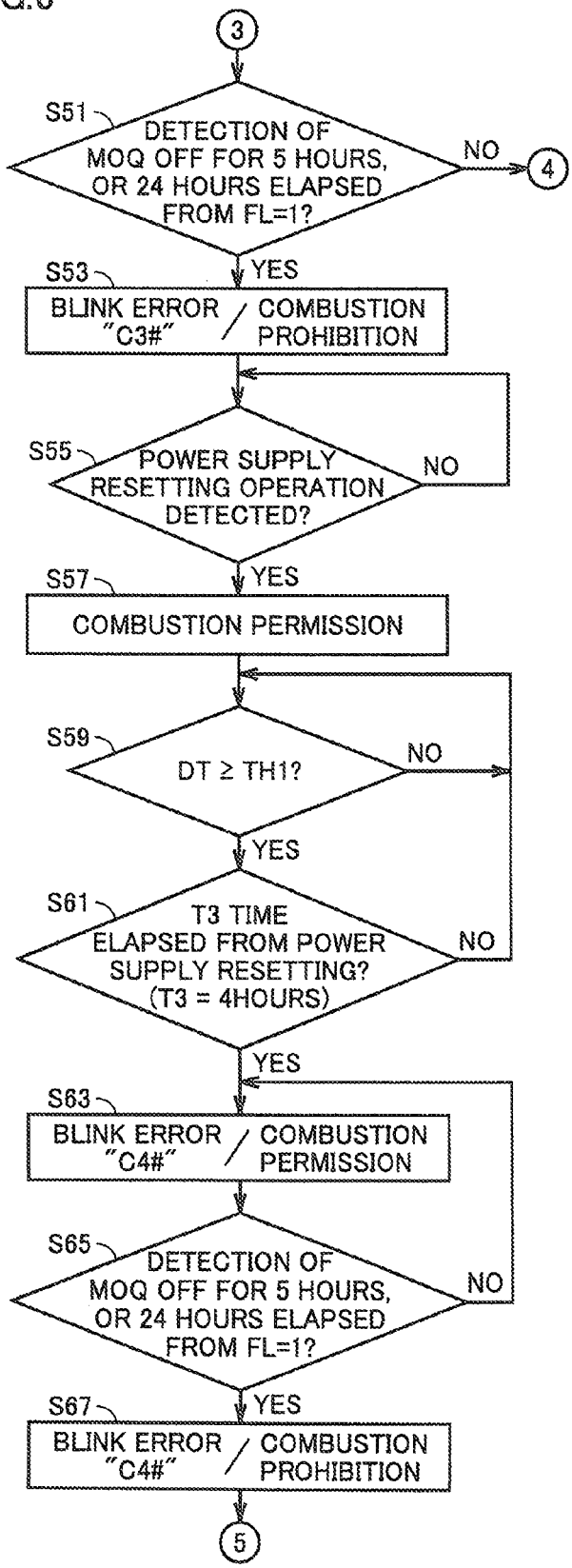
FIG. 6 represents a process flow chart according to the embodiment of the present invention.
Figure 7:
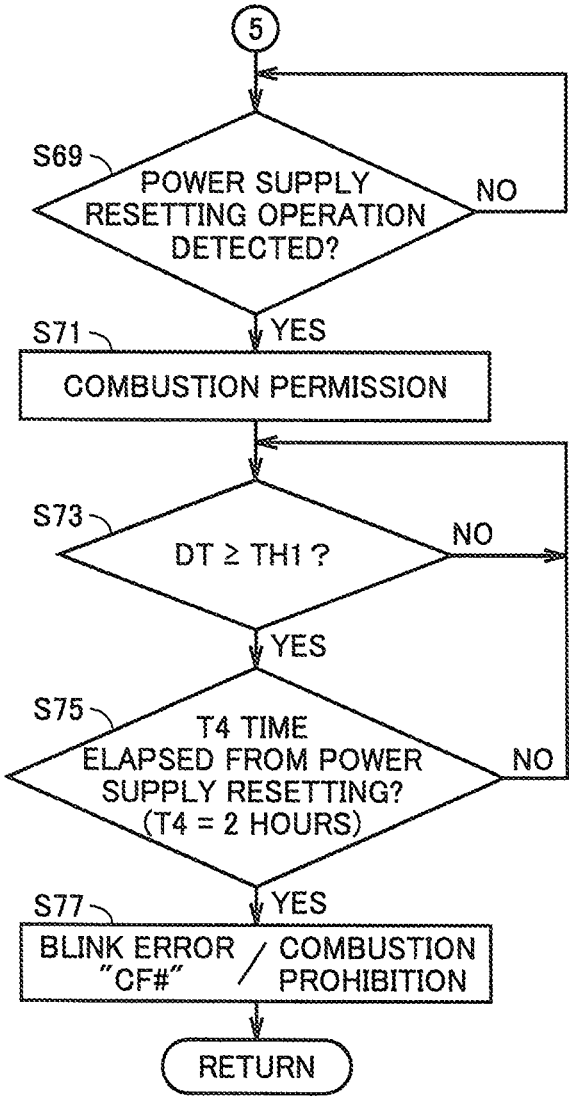
FIG. 7 represents a process flow chart according to the embodiment of the present invention.

The combustion permission/prohibition process will be described with reference to the flow charts of FIGS. 5 to 7.

Firstly, controller 10 implements a routine RT. In routine RT, output controller 10*g* allows display unit 11 to display an error ("C1#") by blinking to notify a user an error of abnormality (scale clogging) (S21). In this stage, it is in the state of implementing the combustion permission. Not limited to characters, the error may be displayed with icons and the like.

Controller 10 determines whether or not a first condition (MOQ is not detected for the time period of five hours continuously) or a second condition (twenty-four hours elapsed from setting "1" to flag FL) (S23). When it is determined that none of the conditions is satisfied (NO in S23), the process returns to S21. The determination in S23 is called "grace period determination" which will be described in detail later.

On the other hand, when it is determined that either one of the conditions is satisfied (YES in S23), controller 10 implements safety operation to avoid damage to heat exchanger 3 and the like. Specifically, the combustion prohibition is implemented in the state where the error "C1#" is displayed by blinking (S25). It should be noted that the first time period of the first condition is not limited to five hours. Further, the second time period of the second condition is all necessary to be longer than or equal to the first time period (five hours) and is not limited to twenty-four hours.

Next, based on an output of power supply ON/OFF determination unit 10*b*, controller 10 determines whether or not the power supply resetting operation which is resetting operation for cancelling the combustion prohibition is received (detected) (S27). S27 is repeated while the resetting operation is not received (NO in S27). When the power supply resetting operation is received (YES in S27), controller 10 switches from the combustion prohibition to the combustion permission (cancels the combustion prohibition) (S29).

The power supply resetting operation which is the resetting operation represents the operation that a user detaches and inserts power supply plug 12 from and to a power supply outlet. Power supply ON/OFF determination unit 106 detects whether or not the power supply resetting operation is performed based on an output (voltage signal and the like) from power supply plug 12. While the power supply resetting operation is a user operation for cancelling the combustion prohibition, a kind of operation is not limited to this.

After that, the process of S31 is implemented as with S7 described above. After the power supply resetting operation for cancelling the combustion prohibition is received, even when presence or absence of scale clogging is detected in S31, and the previously implemented detection of scale clogging is erroneous detection, the erroneous detection can be corrected by the process of S31.

Based on an output of timer 10*e*, controller 10 determines whether or not a T1 time has elapsed from reception (S33) of the power resetting operation (S33). For example, variable T1 represents eight hours. When it is determined that the T1 time has not elapsed (NO in S33), the process returns to S31. When it is determined that the T1 time has elapsed (YES in S33), the process proceeds to S35. Then, first routine RT is terminated.

As described above, routine RT is implemented when scale clogging is detected. In routine RT, controller 10 continues implementing combustion for a predetermined time in the state where an error is outputted, and thereafter implements the safety operation (combustion prohibition). Next, when the power supply resetting operation is detected, the combustion permission is implemented for a predetermined third time period (corresponding to the T1 time described above). Also during the predetermined third time period, presence or absence of scale clogging is detected (S31), and it is detected whether or not a present time period has elapsed (S33) when it is detected that scale clogging is present (YES in S33).

In next S35 to S47, controller 10 implements second routine RT. Since second routine RT is similar to the process of S21 to S33, the process which is different will be mainly described herein.

Firstly, in the state where error "C2#" is displayed by blinking (S35), controller 10 implements the grace period determination (S37), and implements the combustion prohibition (S39). After receiving the power supply resetting operation (YES in S41), and determining that a T2 (T2=6) time which is the third time period has elapsed (YES in S47), the process proceeds to S49. Then, second routine RT is terminated.

In second routine RT, the error display is changed from "C1#" to "C2#" to notify that scale clogging is in progress. Further, the time period of implementing the combustion permission after cancelling the combustion prohibition is shortened from T1 (eight hours) to T2 (six hours).

Controller 10 implements third routine RT in S49 to S61 after implementing second routine RT. Since the process of third routine RT is also similar to the process of S21 to S33, the process which is different will be mainly described herein.

Firstly, in the state where error "C3#" is displayed by blinking (S49), controller 10 implements the grace period determination (S51), and subsequently implements the combustion prohibition. After that, when the power supply resetting operation is received (YES in S55), and it is determined that a T3 (T3=4) time which is the third time period has elapsed (YES in S61), the routine proceeds to S63. Then, third routine RT is terminated.

In third routine RT, the error display is changed from "C2#" to "C3#" to notify that the scale clogging is further in progress. Further, the time period of implementing the combustion permission after cancelling the combustion prohibition is shortened from T2 (six hours) to T3 (four hours).

Controller 10 implements fourth routine RT in S63 to S75 after implementing third routine RT. Since the process of fourth routine RT is also similar to the process of S21 to S33 described above, the process which is different will be mainly described herein.

Firstly, in the state where error "C4#" is displayed by blinking (S63), controller 10 implements the grace period determination (S65), and implements the combustion prohibition. After that, when the power supply resetting operation is received (YES in S69), and it is determined that a T4 (T4=2) time which is the third time period has elapsed (YES in S75), the process proceeds to S77. Then, fourth routine RT is terminated.

In fourth routine RT described above, the error display is changed from "C3#" to "C4#" to notify that the scale clogging is further in progress. Further, the time period for implementing the combustion permission after cancelling the combustion prohibition is shortened from T3 (four hours) to T4 (two hours).

When the scale clogging is detected ("1" is set to flag FL) as described above, the combustion prohibition is basically implemented (safety operation is implemented) in the combustion permission/prohibition process (ST9). In the state where the error is displayed by repeatedly implementing routine RT, the combustion permission is implemented for a predetermined time period. Controller 10 counts the number of repetition of routine RT, and it changes the error display such that scale clogging is gradually in progress as the count value becomes greater. Further, the time of implementing the combustion permission is shortened, so that damage to heat exchanger 3 due to scale clogging is prevented.

After determining from the count value that routine RT was implemented for a predetermined number of times (four times), controller 10 changes the blinking display of error from "C4#" to "CF#" and implements the combustion prohibition (S77). The error display "CF#" notifies that "the safety operation due to scale clogging is implemented, thus the safety operation cannot be canceled by the power supply resetting operation". After that, the routine returns to the original process. It should be noted that the number of implementing routine RT is not limited to four times.

Figure 3:
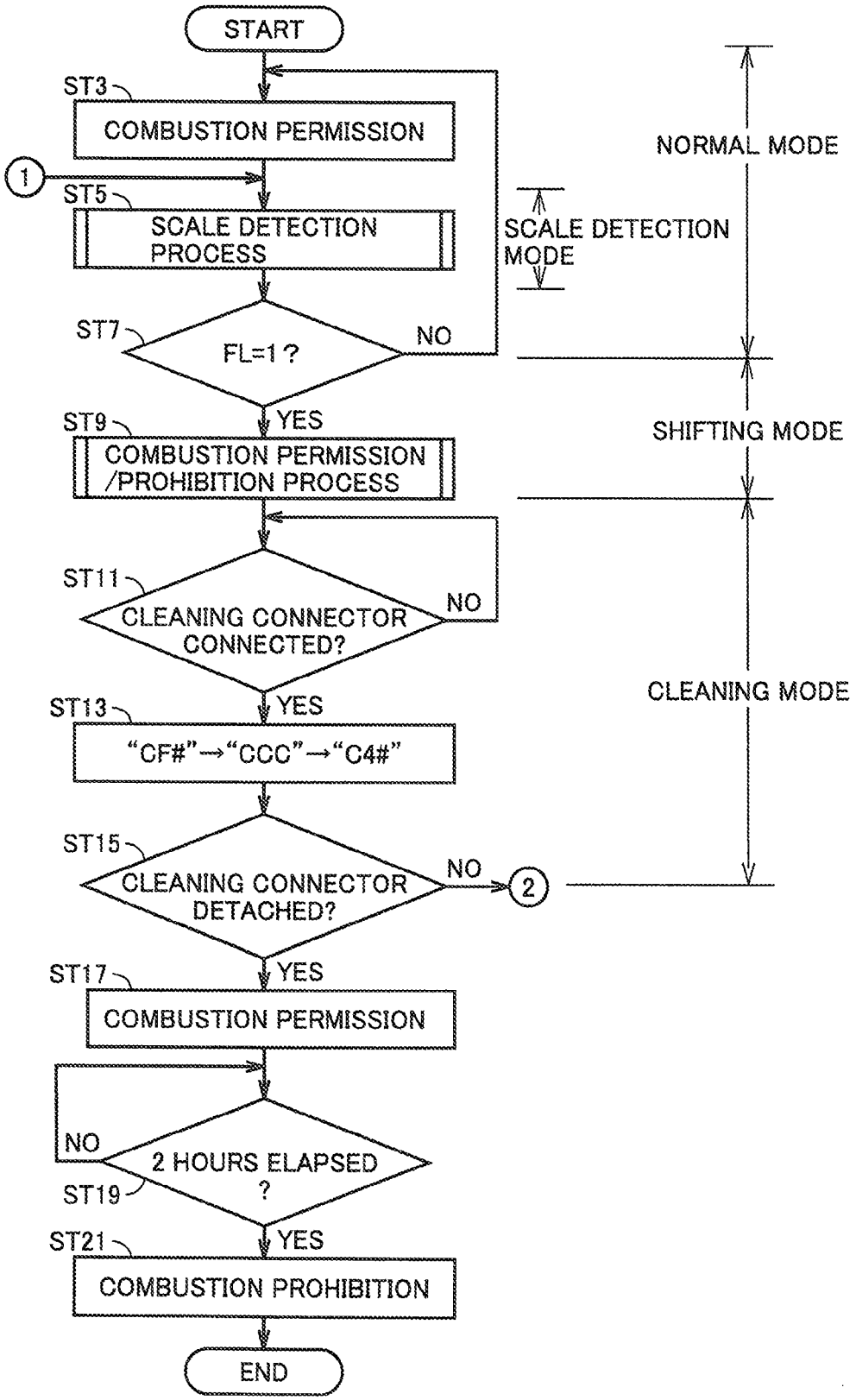
FIG. 3 represents a process flow chart according to the embodiment of the present invention.
Figure 4:
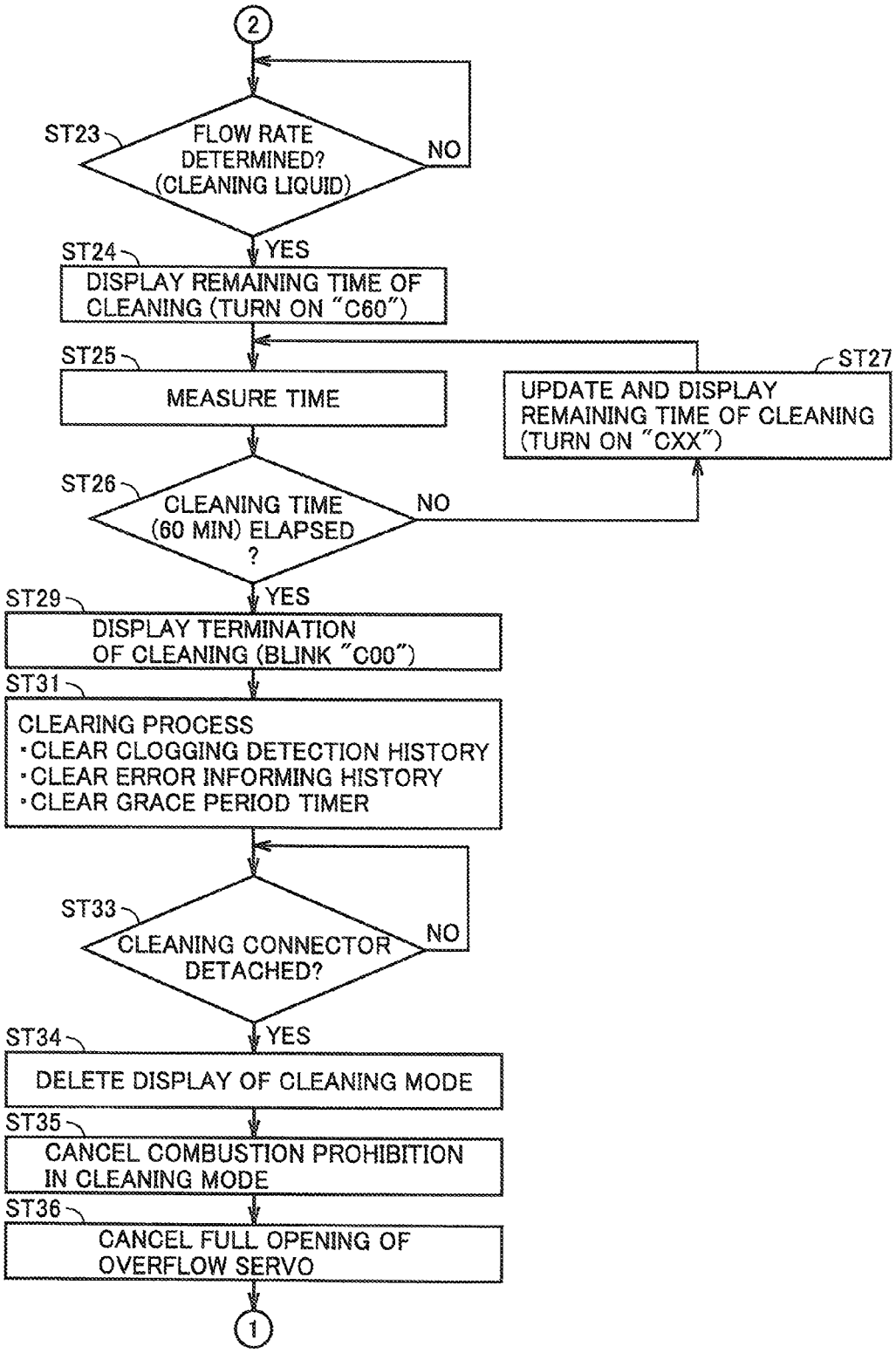
FIG. 4 represents a process flow chart according to the embodiment of the present invention.

Referring to FIG. 3, connector connection detector 10*d* detects whether or not a user connected cleaning connector 16 based on an output of cleaning connector 16 (ST11). In the case where a user would like to cancel the combustion prohibition urgently, such as the case where cleaning liquid is not available, the user performs special predetermined shifting operation, in other words, connects cleaning connector 16. It should be noted that the shifting operation is not limited to this.

When connector connection detector 10*d* does not receive the shifting operation (operation of connection) to the cleaning mode (NO in ST11), ST11 is implemented. On the other hand, when the connection operation is detected (received) (YES in ST11), output controller 10*g* changes the error display in the order of "CF #", "CC00", and "C4#" (ST13). The error display is changed, and the combustion prohibition is canceled, and then it is notified that the combustion permission is implemented for a time period corresponding to "C4#" (for example, two hours).

When the connector connection operation is received, and thereafter connector connection detector 10*d* detects (receives) the cancelling operation, in other words, the operation of detaching cleaning connector 16 (YES in ST15), controller 10 implements the combustion permission for a predetermined time period (two hours) (ST17, NO in ST19). When the predetermined time period has elapsed (YES in ST19), controller 10 implements the combustion prohibition (ST21). After that, the process is terminated. It should be noted that the time period of implementing the combustion permission is not limited to two hours.

As a modified example, when the connection of cleaning connector 16 is detected after ST21, ST11 to ST21 may be implement again to implement the combustion permission of the combustion unit. In this case, controller 10 counts the number of detecting detachment of cleaning connector 16 after the shifting mode is terminated. When the count value exceeds the threshold value, controller 10 implements the combustion prohibition to the combustion unit until the subsequent cleaning mode which will be described later is implemented (this will be referred to as "complete locking"). When the complete locking is implemented, even if cleaning connector 16 is operated, the operation is not received, and the combustion prohibition is not cancelled.

Cleaning Mode

Figure 9:
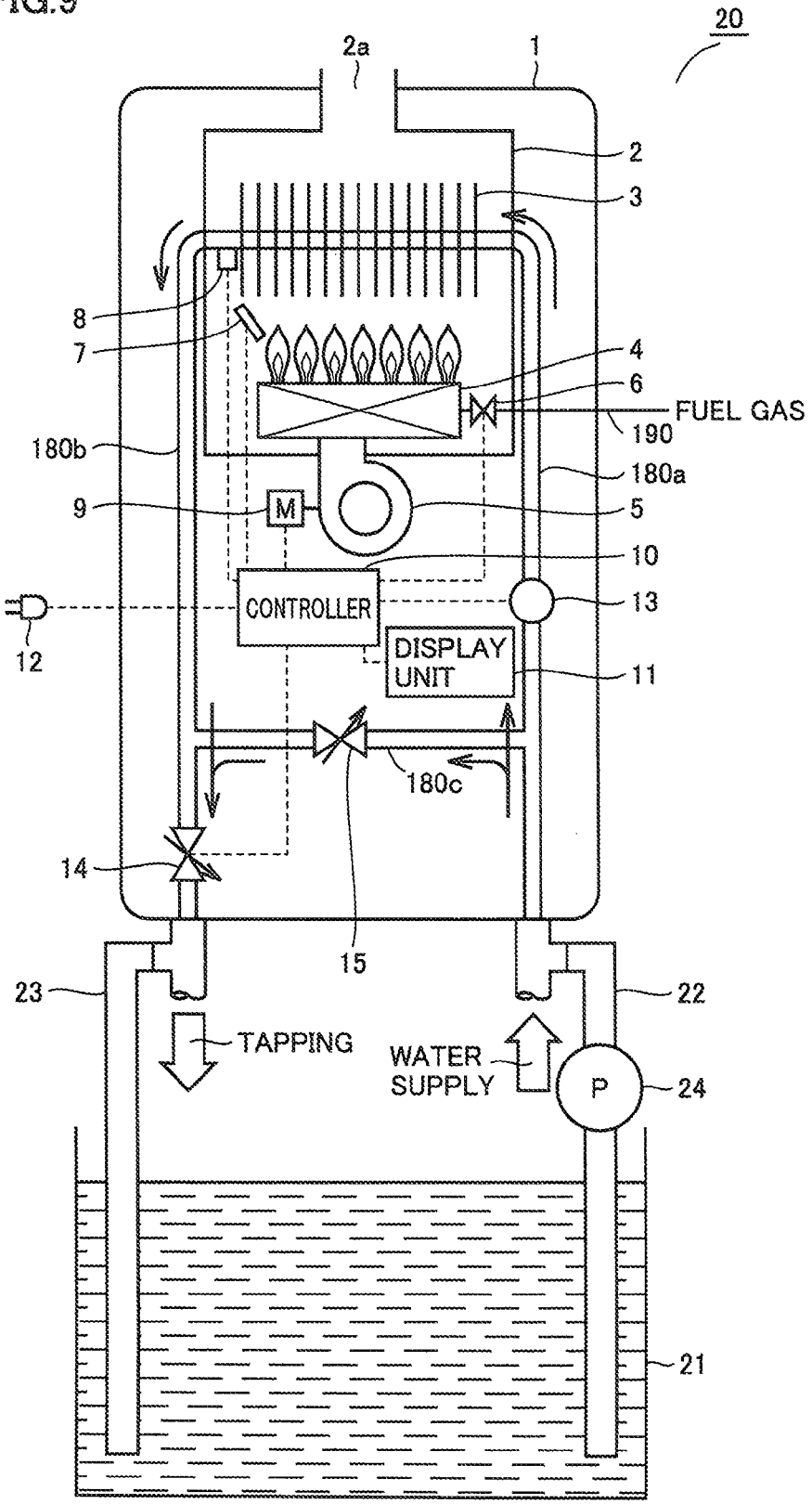
FIG. 9 represents a diagram for describing cleaning of removing a scale according to the embodiment of the present invention.

When the detachment of cleaning connector 16 (cancelling operation) is not detected (NO in ST15), the cleaning mode is implemented for a predetermined time period. Herein, the predetermined time period is sixty minutes, but not limited to it. FIG. 9 represents supply of cleaning liquid to water heating apparatus 20 in the cleaning mode. Referring to FIG. 9, a water tank 21 containing cleaning liquid for removing a scale is prepared. A pipe 22 is connected to a water supply inlet of water heating apparatus 20. Pipe 22 has one opening end connected to the side of the water supply inlet, and the other opening end connected so as to be positioned in the cleaning liquid of water tank 21. Further, pipe 22 is connected with a pump 24 for transferring the cleaning liquid in water tank 21 to heat exchanger 3 through the pipe. Further, a pipe 23 is connected to a tapping outlet of water heating apparatus 20. Pipe 23 has one opening end connected to the side of the tapping outlet and the other opening end connected so as to be positioned in water tank 21.

In the cleaning mode, pump 24 allows the cleaning liquid in water tank 21 to flow into the pipe from the side of the water supply inlet, pass through the pipe, and be discharged from the side of the tapping outlet into water tank 21, so that the cleaning liquid is circulated in the pipe. In this stage, output controller 10*g* performs a control of allowing flow rate adjusting valve 14 to be fully opened and allowing bypass flow rate adjusting valve 15 to be fully closed.

In the cleaning mode, firstly, flow rate determination unit 10*a* determines whether or not the flow rate in the pipe exhibits a predetermined rate based on the output of flow rate sensor 13 (ST23). While it is determined that the flow rate is less than the predetermined rate (NO in ST23), the process of T23 is repeated. When it is determined that the flow rate is greater than or equal to the predetermined rate (YES in ST23), output controller 10*g* allows display unit 11 to turn on "C60" and display a length of a required time (remaining time) to termination of cleaning (ST24).

After that, using timer 10*e*, it is determined whether or not a cleaning time (for example, sixty minutes) has elapsed. In this period of sixty minutes, output controller 10*g* allows display unit 11 to update and display the length of the required time to termination of cleaning (steps ST25, ST26, ST27). Cleaning is terminated when sixty minutes has elapsed, and output controller 10*g* allows display unit 11 to display the termination of cleaning ("C00") by blinking (ST29).

After that, controller 10 implements a clearing process (initialization) for deleting predetermined information stored in storage unit 10*f* (ST31). For example, controller 10 performs a clearing process of a clogging detection history (flag FL=0), a clearing process of an error notifying history, and a clearing process of a timer variable for measuring a grace period. Further, controller 10 may count the number of implemented cleaning and store this count value in a readable non-volatile region in storage unit 10*f* This count value is not cleared. Similarly, it is preferable that the integrated combustion time is also not cleared.

After that, connector connection detector 10*d* determines whether or not cleaning connector 16 has been detached (ST33). When detachment of cleaning connector 16 is not detected (NO in ST33), the process of T33 is repeated. When the detachment is detected (YES in ST33), output controller 10*g* allows display unit 11 to delete the display of the cleaning mode ("C00") (ST34). After that, controller 10 cancels the combustion prohibition and implements the combustion permission (ST35). Further, output controller 10*g* cancels full opening of flow rate adjusting valve 14 (for example, controls so as to close) (ST36). The cleaning mode is terminated, and thereafter shifted to the normal mode of ST5. Further, in ST36, the opening degree of flow rate adjusting valve 14 may be set in accordance with a set value of the previous normal mode (ST3).

In the present embodiment, connection of cleaning connector 16 is set as the shifting operation, and the detachment is set as the cancelling operation. However, the shifting operation may be "detachment" and the cancelling operation may be "connection".

Modified Example

In ST7 of FIG. 8, controller 10 may count a value of variable U (greater than or equal to 0) in accordance with a magnitude of the value of DT, and set "1" to flag FL when the value of variable U exceeds a predetermined value (YES in ST7). For example, variable U is counted up by four when DT exhibits a value greater than or equal to 35 (unit: deg), counted up by two when DT exhibits a value of 35 to 30, and counted down by two when DT exhibits a value less than 30. Consequently, when it is determined that the count value of variable U exhibits a value greater than or equal to 40, controller 10 sets "1" to flag FL. The value of variable U is cleared in ST31.

Grace Period Determination

In the grace period determination described above, the MOQ is referred. The MOQ is a flow rate in heat exchanger 3, and exhibits a minimum flow rate for stable operation of water heating apparatus 20. Flow rate determination unit 10*a* determines whether or not the MOQ is detected based on an output of flow rate sensor 13. When the MOQ is detected, flow rate determination unit 10*a* outputs "ON". When the MOQ is not detected, flow rate determination unit 10*a* outputs "OFF". For example, during the period when hot water is used for a shower, a kitchen, and the like, "ON" is outputted. During the period when hot water is not used, "OFF" is outputted.

Figure 11:
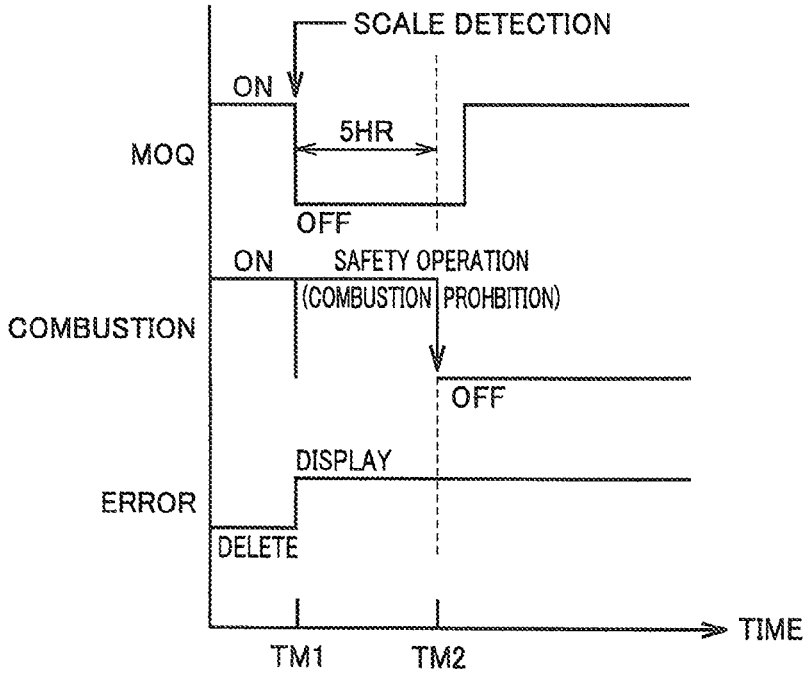
FIG. 11 represents a timing chart according to the embodiment of the present invention.

FIG. 11 represents a timing chart for detection of the MOQ, a timing chart for the combustion operation, and a timing chart for the error display, which are associated with each other. In the timing charts, the vertical axis represents a common time for these timing charts, and the vertical axis represents a signal level. Referring to FIG. 11, flow rate determination unit 10*a* outputs "OFF" from time TM1 in the state where scale clogging is detected. Controller 10 does not implement combustion prohibition immediately even when "OFF" is outputted from flow rate determination unit 10*a* during implementation of the combustion permission, but it implements the combustion prohibition when "OFF" has continued for five hours (time TM2) which is the first time period. Further, output controller 10*g* allows display unit 11 to start error display from time TM1.

As shown in FIG. 11, the combustion permission is implemented in the state where the error is displayed even after the scale clogging is detected. However, when the MOQ is not detected continuously for the first time period (five hours) after the detection of scale clogging, in other words, when it is determined that hot water of water heating apparatus 20 would not be used for a while, the combustion prohibition (safety operation) is implemented in the state where the error is displayed.

Figure 12:
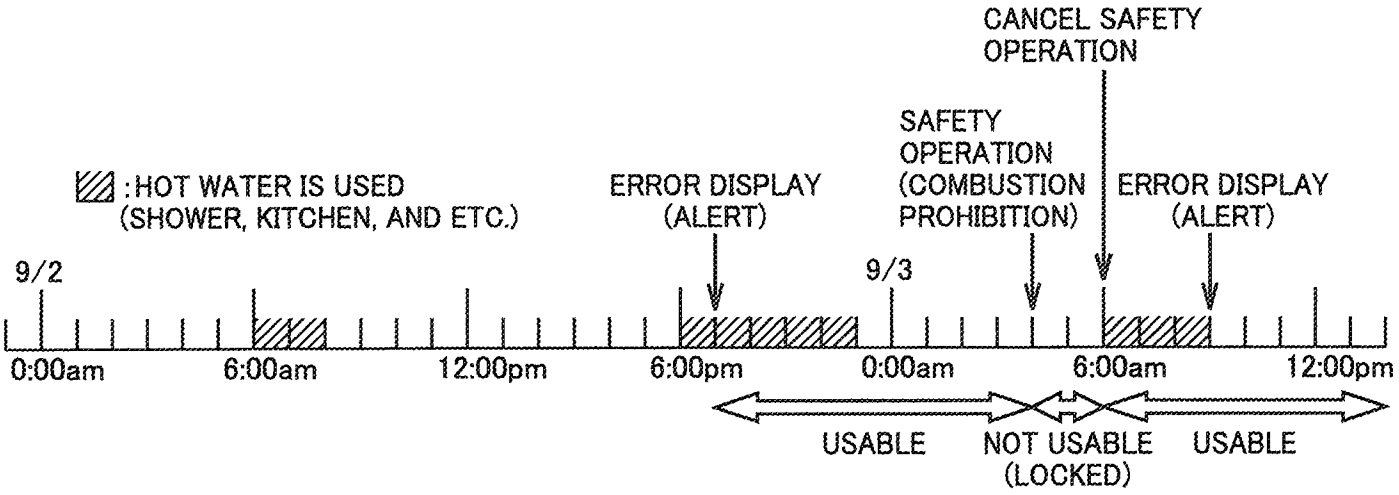
FIG. 12 represents a timing chart according to the embodiment of the present invention.

Next, referring to FIG. 12, a specific example as to the determination of the five hours will be described. FIG. 12 shows an elapsed time on the horizontal axis. The hatched portion on the time axis represents a time zone during which hot water from water heating apparatus 20 is used in a bathroom, a kitchen, or the like. Referring to the drawings, it is assumed that scale clogging is detected and the error is displayed when hot water is used in the combustion permission state at 6:00 pm of September 2nd. After that, the combustion permission is implemented even when the MOQ is not detected as long as it is within the first time period (five hours), thus water heating apparatus 20 can be used.

When the "OFF" of the MOQ continues for five hours or longer, controller 10 switches the combustion permission to the combustion prohibition (safety operation). Next morning, when a user attempts to use a shower, water heating apparatus 20 is in the safety operation, thus the shower cannot be used. After that, when controller 10 receives resetting operation (power supply resetting operation) for cancelling the combustion prohibition, it cancels the combustion prohibition. When the combustion prohibition is canceled, the combustion permission is temporarily implemented. For example, a user can use water heating apparatus 20 in the morning.

Figure 13:
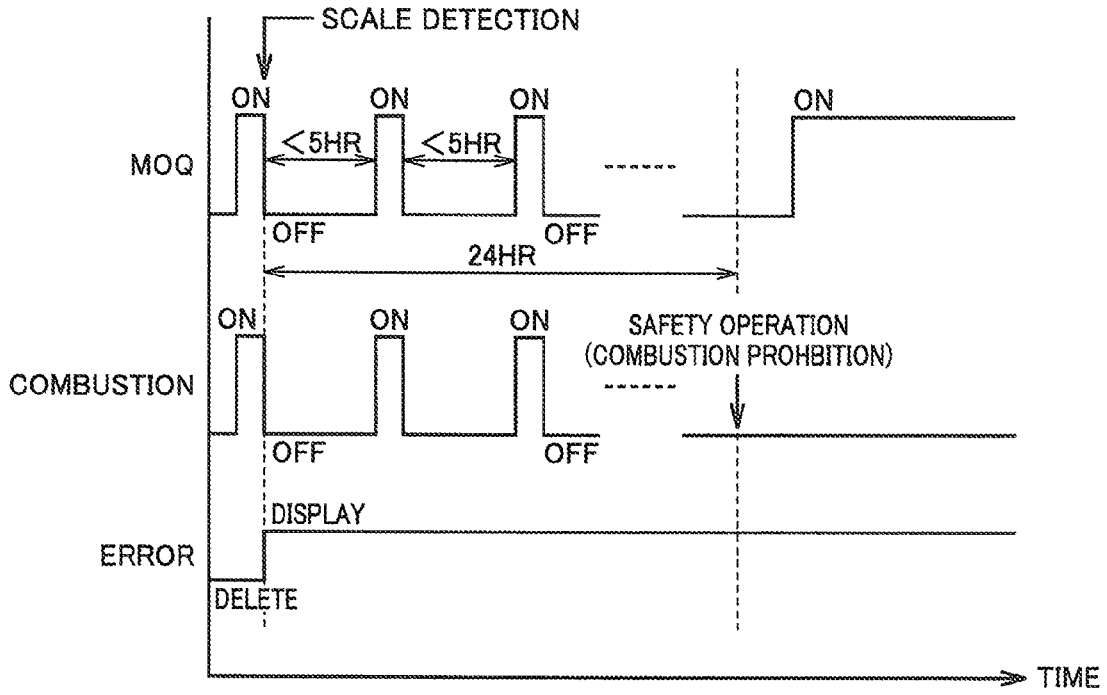
FIG. 13 represents a timing chart according to the embodiment of the present invention.

Referring to FIG. 13, the case of combining the determination of the first time period with the determination of the second time period (twenty-four hours) will be described. When the state where "ON" of the MOQ is detected before an elapse of the first time period (five hours) although the "OFF" of the MOQ is detected is repeated, the combustion prohibition (safety operation) is not implemented, and the combustion permission may be continued for a long time.

In this case, as shown in FIG. 13, the safety operation (combustion prohibition) is implemented forcibly after an elapse of the second time period (twenty-four hours) from the scale detection. Accordingly, damage to heat exchanger 3 due to scale clogging can be prevented while maintaining convenience for a user of water heating apparatus 20 even after detection of scale clogging.

Characteristics of the Embodiment

In the present embodiment, when scale clogging is detected, controller 10 implements the combustion prohibition while outputting an error ("C1#" to "C4#", and "CF#") and prompts a user to implement cleaning. Further, in the cleaning mode, a required time (remaining time) to completion of cleaning is notified. After the cleaning is completed, the history of scale clogging detection and the history of error notifying are deleted, and thereafter the combustion permission is implemented continuously.

In the present embodiment, when the scale clogging is detected, controller 10 does not implement the combustion prohibition immediately but firstly outputs an error, and implements the combustion prohibition when it is determined that water heating apparatus 20 is not used for a long time according to the grace period determination. Thus, the combustion permission can be implemented even when the scale clogging is detected.

In the present embodiment, when the scale clogging is detected, controller 10 outputs an error and implements the combustion prohibition. Even in such a case, when the special operation (operation of cleaning connector 16) is detected, the combustion permission is implemented provisionally.

Next, the effect of the present embodiment will be described.

According to the present embodiment, controller 10 performs a control of automatically starting the cleaning mode for cleaning inside heat exchanger 3 when the shifting operation to the cleaning mode is detected after controller 10 prohibits the combustion operation of burner 4 (for example, connection operation of cleaning connectors by an operator shown in FIG. 10). As described above, since the cleaning mode is started automatically, damage to heat exchanger 3 due to scale clogging can be prevented appropriately. Further, whether or not cleaning has been performed for a required time or whether or not the cleaning operation itself was performed assuredly can be determined on the side of water heating apparatus 20, and the operation on the side of equipment required for cleaning can be performed. Accordingly, the cleaning operation can be performed more accurately and promptly as compared to the case where an operator manually performs the cleaning operation and associated works. From the above, convenience in the case of cleaning the scale can be enhanced.

Further, when the cleaning mode is started, controller 10 controls display unit 11 to display a required time to termination of the cleaning mode. Accordingly, an operator can accurately know the time to termination of the cleaning operation.

Further, controller 10 stores in storage unit 10*f* the detection history of detection of the scale clogging by scale detector 8 and the notifying history of error notified by the notifying unit (for example, display unit 11). When the cleaning mode is terminated, controller 10 deletes the detection history and the error notifying history from storage unit 10*f*. By deleting the history after the scale is removed by such cleaning, the scale clogging detection and error notifying can be started from the initial state.

Further, when the cancelling operation of the cleaning mode is detected after the error notifying history is deleted, controller 10 performs a control of cancelling the prohibition of the combustion operation of burner 4. Accordingly, a user can use water heating apparatus 20 without restriction until the next scale clogging is detected.

Although the present invention has been described and illustrated in detail, it is clearly understood that the same is by way of illustration and example only and is not to be taken by way of restriction, the scope of the present invention being interpreted by the terms of the appended claims.

What is claimed is:

1. A water heating apparatus, comprising:

a burner;

a heat exchanger for heating hot and cold water with use of heat from said burner;

a scale detector for detecting occurrence of scale clogging in said heat exchanger;

a notifying unit for notifying an error when said scale detector detects occurrence of a scale greater than or equal to a predetermined amount;

a pair of connecting terminals; and a controller for controlling said notifying unit to notify an error and prohibiting combustion operation of said burner after said error is notified when said scale detector detects occurrence of a scale greater than or equal to said predetermined amount, said controller being configured to start a cleaning mode for cleaning inside said heat exchanger when user's shifting operation to said cleaning mode is received by the controller after said combustion operation of said burner is prohibited by said controller, wherein the pair of connecting terminals is configured to include a first terminal portion and a second terminal portion, one end of the first terminal portion and one end of the second terminal portion are configured to allow connection to and disconnection from each other by a user's operation, and the other end of the first terminal portion and the other end of the second terminal portion are configured to be electrically connected to the controller, wherein one of the user's operation for a connection and the user's operation for a disconnection is to be set as the shifting operation to the cleaning mode, and wherein said cleaning mode includes supplying a cleaning liquid from a water tank to said heat exchanger to thereby remove scale clogging in said heat exchanger.

2. The water heating apparatus according to claim 1, wherein said notifying unit includes a display unit, and said controller is configured to control said display unit to display a required time to termination of said cleaning mode when said cleaning mode is started.

3. The water heating apparatus according to claim 1, wherein said controller is configured to store in a storage unit a detection history of detection of scale clogging by said scale detector and an error notifying history of an error notified by said notifying unit in said cleaning mode, and delete said detection history and said error notifying history from said storage unit when said cleaning mode is terminated.

4. The water heating apparatus according to claim 3, wherein said controller is configured to cancel prohibition of the combustion operation of said burner when said controller receives the operation of cancelling said cleaning mode after said error notifying history is deleted.

5. The water heating apparatus according to claim 1, wherein said controller is configured to switch an operation mode of said water heating apparatus to a shifting mode for shifting to said cleaning mode based on a comparison between an integrated value of a combustion time of said burner and a predetermined value, and on detection of scale clogging by said scale detector.

6. The water heating apparatus according to claim 1, further comprising a sensor for detecting a flow rate in said heat exchanger, wherein said controller is configured to prohibit the combustion operation of said burner when a time during which a predetermined flow rate is not detected by said sensor continues for a first time period after said error is outputted, or when a second time period elapses after scale clogging is detected.

7. The water heating apparatus according to claim 6, wherein said controller is configured to cancel the prohibition of the combustion operation of said burner for a third time period when said controller receives resetting operation by the user after the combustion operation of said burner is prohibited.

8. The water heating apparatus according to claim 6, wherein said controller is configured to control said display unit to output an error when a third time period elapses after prohibition of the combustion operation of said burner is canceled and scale clogging is detected, and said controller is configured to prohibit combustion of said burner again when a time during which a predetermined flow rate is not detected in said heat exchanger continues for a first time period after the error is outputted or when a second time period elapses after the scale clogging is detected.

9. The water heating apparatus according to claim 7, wherein said controller is configured to shorten said predetermined third time period as a number of cancelling the prohibition of the combustion operation of said burner increases.

10. The water heating apparatus according to claim 9, wherein said controller is configured to switch the operation mode of said water heating apparatus to said cleaning mode when a number of cancelling the prohibition of the combustion operation of said burner exhibits a predetermined number and said controller receives the shifting operation.

11. The water heating apparatus according to claim 1, wherein said controller is configured to cancel prohibition of combustion operation of the burner for a predetermined time period when said controller receives cancelling operation prior to switching to a cleaning mode after the combustion operation of said burner is prohibited.

12. The water heating apparatus according to claim 11, wherein the other of the user operation for the connection and the user operation for the disconnection is set for said cancelling operation.

13. The water heating apparatus according to claim 11, wherein said controller is configured to cancel the prohibition of the combustion operation of said burner for a predetermined time period and thereafter prohibit again the combustion operation of said burner.

* * * * *